US008196242B2

(12) United States Patent
Kim et al.

(10) Patent No.: US 8,196,242 B2
(45) Date of Patent: Jun. 12, 2012

(54) METHOD OF CONTROLLING DRYING CYCLE IN A WASHING MACHINE BASED ON SENSED TEMPERATURE

(75) Inventors: Kwang Soo Kim, Changwon-si (KR); Jae Mun Kim, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 1494 days.

(21) Appl. No.: 10/923,784

(22) Filed: Aug. 24, 2004

(65) Prior Publication Data

US 2005/0044639 A1 Mar. 3, 2005

(30) Foreign Application Priority Data

Aug. 26, 2003 (KR) ..... 10-2003-0059109

(51) Int. Cl.
*D06F 25/00* (2006.01)
*D06F 33/02* (2006.01)

(52) U.S. Cl. ..... 8/158; 68/20

(58) Field of Classification Search ..... 68/12.03, 68/12.15, 12.21, 19.2, 20; 8/158, 159
See application file for complete search history.

(56) References Cited

U.S. PATENT DOCUMENTS 2,911,810 A * 11/1959 Lantz et al. ..... 68/12.15
3,624,918 A 12/1971 Heftier
4,485,566 A 12/1984 Vivares et al.
5,207,764 A * 5/1993 Akabane et al. ..... 68/20
5,887,456 A * 3/1999 Tanigawa et al. ..... 68/20
6,393,918 B2 * 5/2002 French et al. ..... 73/660

FOREIGN PATENT DOCUMENTS

| | | | |
|---|---|---|---|
| CN | 1153839 | A | 7/1997 |
| DE | 1924961 | | 11/1970 |
| DE | 3017109 | A1 | 11/1970 |
| EP | 0684335 | A1 | 11/1995 |
| EP | 0761864 | | 3/1997 |
| EP | 0763618 | A2 | 3/1997 |
| EP | 0763618 | A3 | 7/1997 |
| GB | 977874 | | 12/1964 |
| GB | 2236334 | A | 4/1991 |
| JP | 08-191995 | | 7/1996 |
| JP | 2003-053087 | | 2/2003 |

OTHER PUBLICATIONS

European Search Report dated Dec. 8, 2005.

* cited by examiner

*Primary Examiner* — Joseph L Perrin
(74) *Attorney, Agent, or Firm* — McKenna Long & Aldridge LLP

(57) ABSTRACT

The present invention provides a washing machine and method of controlling a drying cycle thereof, by which a laundry can be evenly distributed within a drum rotated at a second speed for a low-speed dewatering cycle during the drying cycle to further enhance a drying effect. Once the drying cycle is initiated, a blower fan and heater are driven to circulate hot air within the washing machine via tub and circulation duct. And, the drum is rotated by applying a first rotational speed for a normal drying cycle and a second rotational speed for a low-speed dewatering cycle with a prescribed duty ratio.

13 Claims, 4 Drawing Sheets

METHOD OF CONTROLLING DRYING CYCLE IN A WASHING MACHINE BASED ON SENSED TEMPERATURE

This application claims the benefit of Korean Application (s) No. 10-2003-0059109 filed on Aug. 26, 2003, which is/are hereby incorporated by reference.

BACKGROUND OF THE INVENTION

1. Field of the Invention

The present invention relates to a method of controlling a drying cycle in a washing machine.

2. Discussion of the Related Art

Generally, a drum type washing machine adopts a washing system using a friction between a laundry and a drum rotated by receiving a drive force of a motor unit while a detergent water, and laundry are held within the drum. The drum type washing machine is advantageous in causing less damage to the laundry, preventing the laundry from being raveled, and providing washing effects of beating and rubbing.

Meanwhile, in order to cope with the functional improvement and high-quality rend of the rum type washing machine, a laundry-drying function is provided to the drum type washing machine as well as the conventional washing and dewatering functions. Accordingly, the demand for a drum type washier/dryer tends to rise.

The drum type washer/dryer dries a laundry within a drum in a manner of sucking to heat an external air using a fan and heater provided outside a tub and blowing the heated air into the tub.

FIG. 1 and FIG. 2 are cross-sectional diagrams of a drum type washing machine equipped with a drying function according to a related art.

Referring to FIG. 1 and FIG. 2, a cylindrical tub 2 is provided within a cabinet 1 and a cylindrical drum 3 is provided within the tub 2. A drive shaft 4 is installed at a rear side of the drum 3 to be connected to a motor 5. A drive power of the motor is transferred to the drum 3 to rotate. And, a multitude of perforated holes (not shown in the drawings) are formed on an outer circumference of the drum 3 so that air or water can pass through the perforated holes.

In order to perform a drying cycle of the drum type washing machine, t circulation duct 6 is connected to the tub 2 to form a circulation path of heated air. A blower fan 7 for forcibly blowing air to circulate and a heater 8 for heating the blown air are installed within the circulation duct 6.

A cooling water inlet pipe 9 for supplying cooling water from outside for the condensation of air flowing in the circulation duct 6 is connected to an upper part of the circulation duct 6. A tub temperature sensor 'B' sensing a temperature within the tub 2 is installed within the tub 2, and a duct temperature sensor 'A' sensing a temperature of a circulating air is installed inside the circulation duct 6.

A method of controlling a drying cycle in the drum type washing machine equipped with the drying function according to a related art is explained as follows.

Once a drying cycle is initiated after completion of dewatering, the blower fan 7 is driven to suck air into the circulation duct 6. The air blown to flow in the circulation duct 6 is passed through the heater 8 to be heated at a high temperature and then flows in the drum 3 to exchange heat with a laundry within the drum 3 for drying the laundry.

Meanwhile, the humid air resulting from the heat exchange with the laundry within the tub 2 flows in the circulation duct 6 again by the operation of the blower fan 7. If the hot and humid air is supplied to the heater 8 via the blower fan 7, performance of the blower fan 7 is reduced and efficiency of the heater 8 is considerably lowered. Hence, the cooling water is supplied via the cooling water inlet pipe 9 to condense the hot and humid air flowing from the tub 2. Thus, humidity of the corresponding air is lowered.

As mentioned in the foregoing description, the humidity-lowered air is passed through the heater 8 to be heated at a high temperature and then flows in the tub 2 again, whereby a circulation process of drying the laundry is repeated.

In case of circulating the hot air at the high temperature into the tub 2 in the drying cycle, the motor 5 rotates the drum 3 at a low rotational speed of about 50 RPM so that the hot air can evenly come into contact with the laundry.

In the drum type washing machine equipped with the drying function according to the related art, if a difference (Td–Tt) between a temperature Td sensed by the duct temperature sensor 'A' and a temperature Tt sensed by the tub temperature sensor 'B' is equal to or greater than a first setup value in each drying cycle mode, if the temperature Td sensed by the duct temperature sensor 'A' or the temperature Tt sensed by the tub temperature sensor 'B' is equal to or greater than a second setup value, or if a predetermined time expires from the initiation of the drying cycle, the heater 8 stops being driven but the blower fan 7 is operated during a period of time to perform a cool air drying. Alternatively, the drying cycle is further performed during an additional period of time and is then terminated.

However, the related art drum type washing machine equipped with the drying function intends to make the laundry come into contact with the hot air in a manner of rotating the drum 3 at a low rotational speed by driving the motor 5 during the drying cycle. In case of an excessive amount of the laundry, the laundry fails to be evenly distributed to elongate a corresponding drying time. Moreover, the laundry fails to be evenly dried to reduce a drying effect thereof.

SUMMARY OF THE INVENTION

Accordingly, the present invention is directed to a washing machine and method of controlling a drying cycle thereof that substantially obviate one or more of the problems due to limitations and disadvantages of the related art.

An object of the present invention, which has been devised to solve the foregoing problem, lies in providing a washing machine and method of controlling a drying cycle thereof, by which a laundry can be evenly distributed within a drum during the drying cycle.

It is another object of the present invention to provide a washing machine and method of controlling a drying cycle thereof, by which drying performance is enhanced and by which a drying time is shortened.

In order to achieve the above objects of the present invention, a drum is periodically rotated at a low rotational speed of a dewatering cycle during the drying cycle.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a method of performing a drying cycle in a washing machine having a drum accommodating a laundry and a sensor for detecting a temperature of an air flowing in the drum, including the step of rotating the drum using at least two different rotational speeds during a cycle for drying the laundry within the drum based on the temperature detected by the sensor.

In another aspect of the present invention, there is provided a washing machine including a tub, a drum rotatably installed within the tub to accommodate a laundry, a duct forming an air circulation path together with the tub to communicate with the drum, a first temperature sensor within the tub, a second sensor within the duct, and a control unit rotating the drum using at least two different rotational speeds during a cycle for drying the laundry within the drum based on temperatures detected by the first and second temperature sensors Preferably, the at least two different rotational speeds include a first rotational speed for a normal drying cycle to be applied during the drying cycle and a second rotational speed for a low-speed dewatering cycle to be applied from a time point that the detected temperature reaches a prescribed level.

Preferably, the first rotational speed is 50 RPM and the second rotational speed is 200~600 RPM.

Preferably, the first and second rotational speeds are applied to rotate the drum for agitation with a duty ratio While the drying cycle is carried out, the drum is rotated at a rotational speed corresponding to a low dewatering speed so that the laundry within the drum can be evenly distributed therein. Therefore, the drying performance is enhanced and the drying time is shortened.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
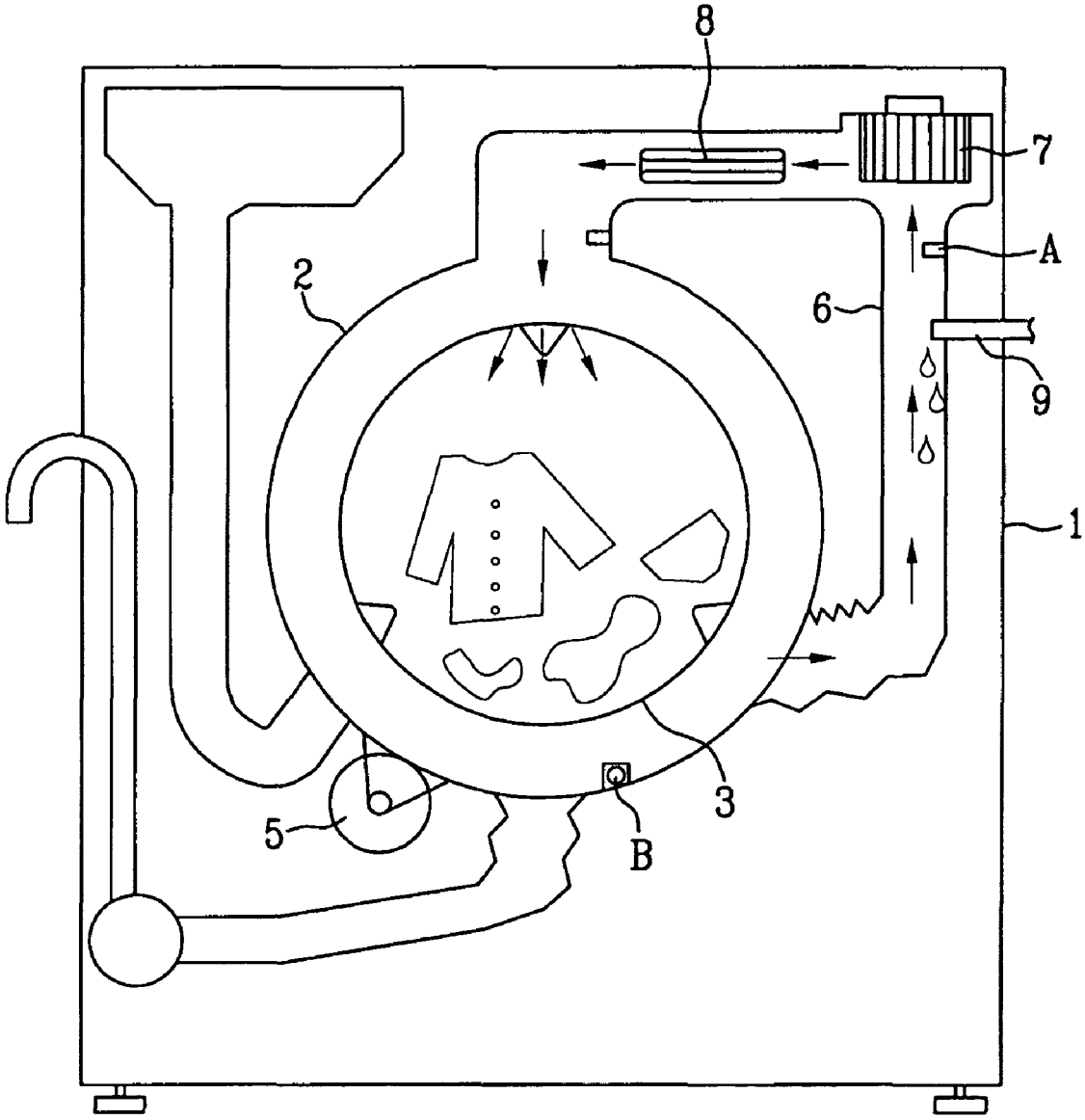
FIG. 1 Background Art
FIG. 1 is a schematic cross-sectional diagram of a drum type washing machine equipped with a drying function according to a related art.
Figure 2:
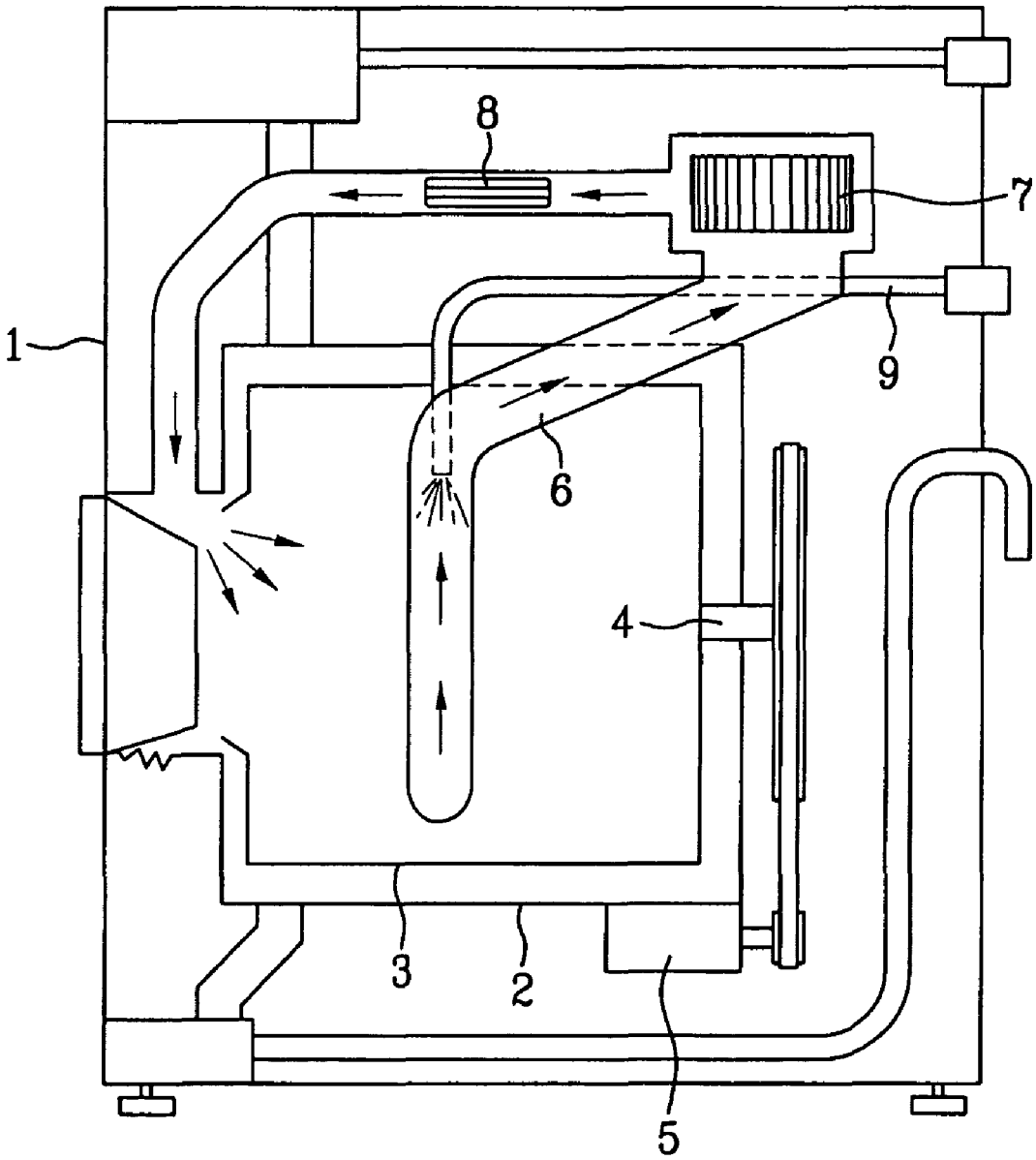
FIG. 2 Background Art
FIG. 2 is another schematic cross-sectional diagram of a drum type washing machine equipped with a drying function according to a related art.

For the understanding of the present invention, the following description of the present invention refers to the configuration of the related art drum type washing machine equipped with the drying function in FIG. 1 and FIG. 2.

Figure 3:
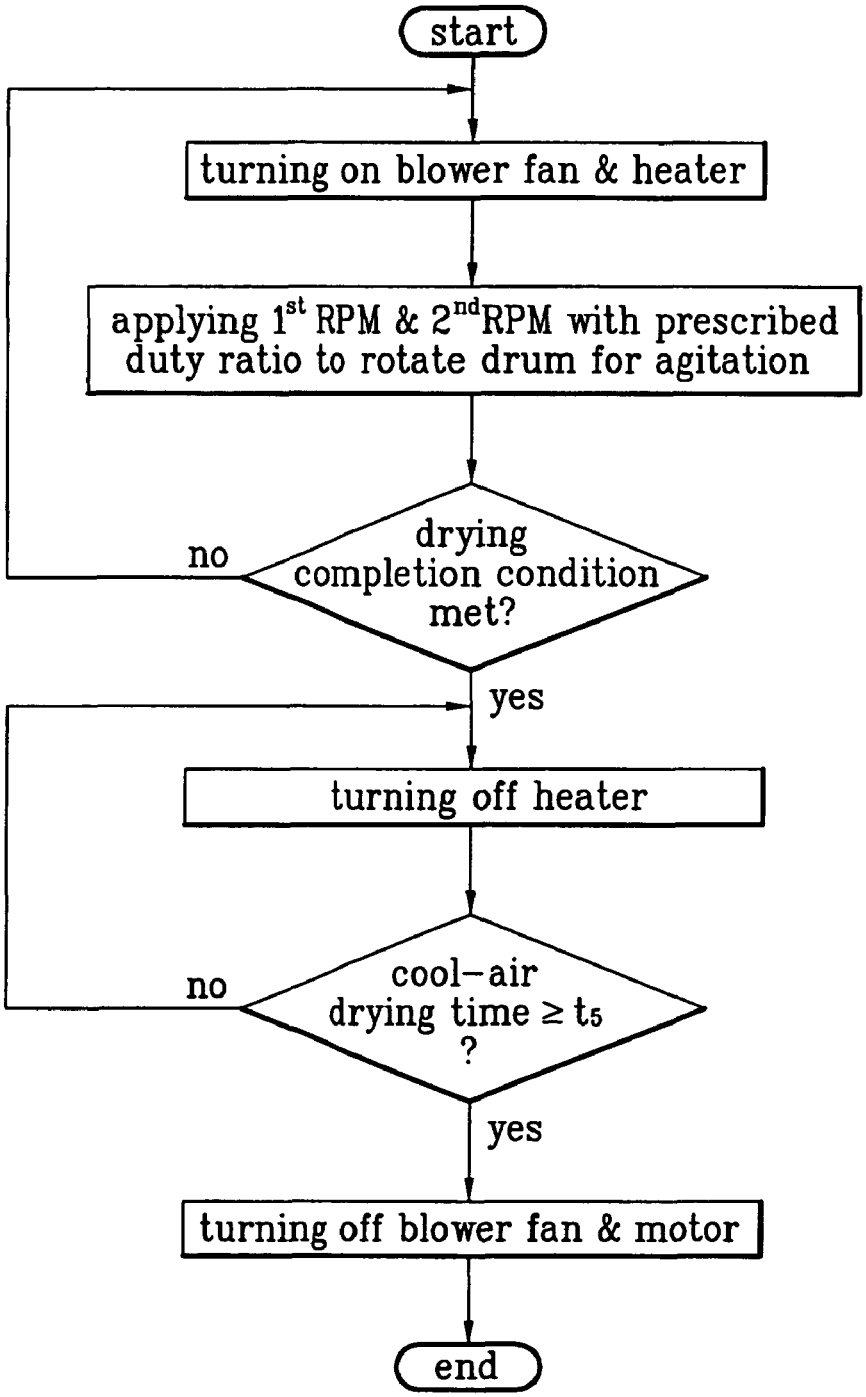
FIG. 3 is a flowchart of a method of controlling a drying cycle in a washing machine according to a first embodiment of the present invention.

FIG. 3 is a flowchart of a method of controlling a drying cycle in a washing machine according to a first embodiment of the present invention.

Referring to FIG. 3, a control unit (not shown in the drawing) rotates the drum 3 at two different rotational speeds during a cycle for drying the laundry within the drum 3. In doing so, the two different rotational speeds (RPMs) include a first rotational speed for a normal drying cycle and a second rotational speed for a low-speed dewatering cycle, respectively.

Specifically, the first rotational speed is 50 RPM (revolutions per minute) and the second rotational speed ranges 200-600 RPM. And, each of the first and second rotational speeds is applicable with a duty ratio for rotating the drum 3 for agitation during the drying cycle.

The first embodiment of the present invention is explained in detail by referring to FIG. 3 as follows.

First of all, once a drying cycle is initiated after completion of a dewatering cycle, the blower fan 7 and heater 8 are turned on so that air can be sucked into the circulation duct 6. The air having been sucked into the circulation duct 6 is heated by the heater 8 and is then blown into the tub 2 to dry the laundry within the drum 3. The air becoming humid as a result of having dried the laundry flows in the circulation duct 6 again. The air having flown in the circulation duct 6 again is then condensed by the cooling water supplied via the cooling water inlet pipe 9 so that its humidity is lowered.

In doing so, the control unit periodically applies the first rotational speed according to a first duty ratio of the first and second rotational speeds to rotate the drum 3 for agitation via the motor 5. Hence, alternate rotations (rotations in forward and reverse directions) for agitation are performed on the drum 3 at the first rotational speed (about 50 RPM) during a first time t1 according to a second duty ratio t1/t2 of the first time t1 to a second time t2 and the motor 5 is then stopped during the second time t2. In this case, the first time t1 for rotating the drum 3 at the first rotational speed for agitation is set to about 16 seconds. And, the second time t2 for stopping the motor 5 is set to about 2 seconds.

It is apparent that the first and second times t1 and t2 are not limited to 16 seconds and 2 seconds but can be set to different times, respectively. Moreover, at least two speeds are applicable to the first embodiment of the present invention despite the above-explained two different speeds. As mentioned in the foregoing description, the alternate rotations for agitation of the drum 3 by the motor 5 keep being driven from a start time point of the drying cycle to an end time point thereof.

Moreover, the control unit periodically applies the second rotational speed according to the first duty ratio of the first and second rotational speeds to rotate the drum 3 for agitation via the motor 5. Hence, alternate rotations (rotations in forward and reverse directions) for agitation are performed on the drum 3 at the second rotational speed (about 200~600 RPM) during a third time t3 according to a third duty ratio t3/t4 of the third time t3 to a fourth time t4 and the drum 3 is then stopped rotating during the fourth time t4. In this case, the third time t3 for rotating the drum 3 at the second rotational speed for agitation is set to about 180 seconds. And, the fourth time t4 for stopping the motor 5 is set to about 10 seconds.

It is apparent that the third and fourth times t3 and t4 are not limited to 180 seconds and 10 seconds but can be set to different times, respectively. Moreover, at least two speeds are applicable to the first embodiment of the present invention despite the above-explained two different speeds. As mentioned in the foregoing description, the alternate rotations for agitation of the drum 3 by the motor 5 keep being driven from a start time point of the drying cycle to an end time point thereof.

As mentioned in the foregoing description, when the drying cycle is in progress by turning on the blower fan 7, heater 8, and motor 5, the control unit controls the motor 5 to rotate at the second rotational speed, i.e., the low dewatering speed of 200~600 RPM, from the start time point of the drying cycle to the end time point according to the first duty ratio of the first rotation speed to the second rotational speed.

In doing so, the laundry within the drum 3 is evenly distributed therein as the drum 3 is rotated at the second rotational speed of the low dewatering speed. And, the third time t3 for rotating the motor 5 for agitation at the second rotational speed and the fourth time t4 for stopping the motor 5 can be modified by a manufacturer of the washing machine by considering the optimal drying condition. Hence, it is apparent that the third and fourth times t3 and t4 can be set to other values as well as 180 seconds and 10 seconds, respectively.

Meanwhile, once a drying completion condition is met while the drying cycle is carried out, the control unit stops driving the heater 8 but keeps driving the blower fan 7 and motor 5 to perform a cool-air drying during a predetermined time t5.

After the time t5 expires from the initiation of the cool-air drying, the control unit stops driving the blower fan 7 and motor 5 so that the drying cycle can be completed.

Meanwhile, the drying completion condition can be decided by various factors. For instance, if a temperature sensed by the duct temperature sensor 'A' in FIG. 1 is equal to or greater than the setup value or a temperature sensed by the tub temperature sensor 'B' in FIG. 1 is equal to or greater than the setup value, the control unit considers the drying cycle meets the drying completion condition. Moreover, if the difference between the temperature sensed by the duct temperature sensor 'A' and the temperature sensed by the tub temperature sensor 'B' deviates to a predetermined value from a maximum value, the control unit also considers the drying cycle meets the drying completion condition.

Besides, if the setup time expires from the start time point of the drying cycle, the control unit considers the drying cycle meets the drying completion condition as well.

Thus, once it is decided that the drying cycle meets the drying completion condition, the control unit carries out the cool-air drying step.

In doing so, after the drying completion condition is sensed by the control unit, the drying cycle can be terminated by turning off the heater 8, blower fan 7, and motor 5 instead of entering the cool-air drying step.

Meanwhile, in the first embodiment of the present invention, the drum 3 is periodically rotated using the first and second rotational speeds from the start time point of the drying cycle. Yet, in the second embodiment of the present invention, a low-speed dewatering RPM, i.e., the second rotational speed is applied to rotating the drum 3 if a specific condition is met after the initiation of the drying cycle.

In the second embodiment of the present invention, the control unit rotates the drum 3 at two different rotational speeds during a cycle for drying the laundry within the drum 3 based on the temperatures detected by the sensors.

In this case, the two different rotational speeds include a first rotational speed for a normal drying cycle applied to the crying cycle and a second rotational speed for a low-speed dewatering cycle. And, the second rotational speed is applicable from a time point that the detected temperature reaches a prescribed level. In the second embodiment of the present invention, the first rotational speed is 50 RPM and the second rotational speed is 200~600 RPM.

Similar to the control unit of the first embodiment of the present invention, the control unit of the second embodiment of the present invention uses the first rotational speed only in rotating the drum for agitation until the detected temperature reaches the prescribed level. Once the detected temperature reaches the prescribed level, the first and second rotational speeds are reciprocally applied to the agitating rotation of the drum with the first duty ratio.

Figure 4:
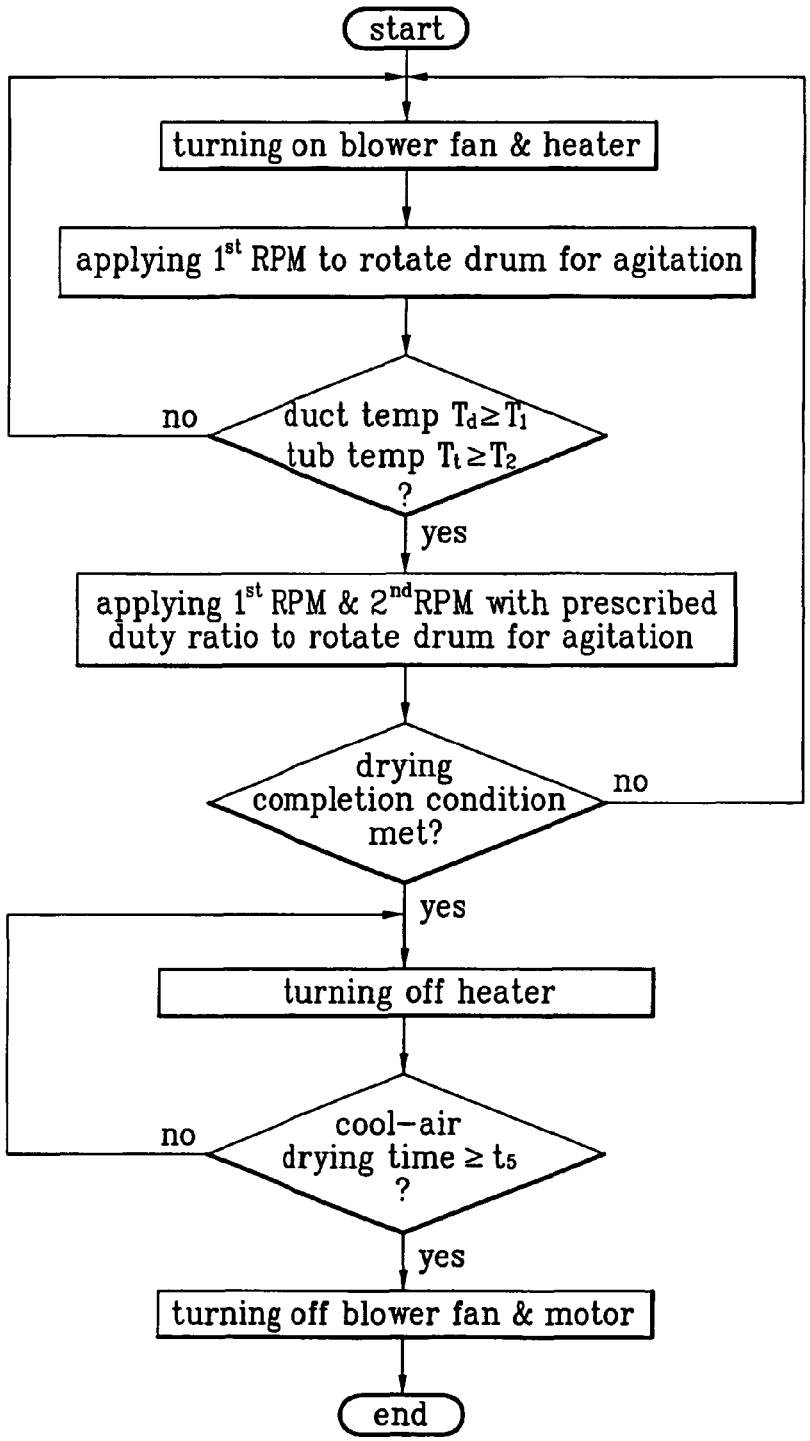
FIG. 4 is a flowchart of a method of controlling a drying cycle in a washing machine according to a second embodiment of the present invention.

FIG. 4 is a flowchart of a method of controlling a drying cycle in a washing machine according to a second embodiment of the present invention.

Referring to FIG. 4, once a drying cycle is initiated by turning on the blower fan 7, heater 8, and motor 5, the control unit rotates the drum 3 using the first rotational speed only. Namely, the control unit periodically applies the first rotational speed to the agitating rotation of the drum 3 via the motor 5. In doing so, alternate rotations (rotations in forward and reverse directions) for agitation are performed on the drum 3 at the first rotational speed (about 50 RPM) during a first time t1 according to a second duty ratio t1/t2 of the first time t1 to a second time t2 and the motor 5 is then stopped during the second time t2. In this case, the first time t1 for rotating the motor 5 at the first rotational speed for agitation is set to about 16 seconds. And, the second time t2 for stopping the motor 5 is set to about 2 seconds.

It is apparent that the first and second times t1 and t2 are not limited to 16 seconds and 2 seconds but can be set to different times, respectively. While the drum 3 is rotated at the first rotational speed (RPM) only, if the temperature Td sensed by the duct temperature sensor 'A' is equal to or greater than a first temperature T1 or if the temperature Tt sensed by the tub temperature sensor 'B' is equal to or greater than a second temperature T2, both of the first rotational speed and the second rotational speed are used in rotating the motor 5 and drum 3 based on the first duty ratio. In doing so, the second rotational speed is the low dewatering speed of 200~600 RPM.

And, the rest steps of the drying cycle are equivalent to those of the first embodiment of the present invention, thereby being skipped in the following description.

In an initial stage of the drying cycle at a relatively low temperature of the circulating air, there is no big difference in heat exchange performance even if the laundry is agitated by rotating the drum 3 at the low dewatering speed according to the second rotational speed. Hence, in the second embodiment of the present invention, the drum 3 is periodically rotated at the low dewatering speed in a high temperature state providing a considerable effect of the heat exchange performance. Therefore, power consumption of the second embodiment of the present invention is less than that of the first embodiment of the present invention.

In the second embodiment of the present invention like the first embodiment of the present invention, by rotating the drum 3 at the low dewatering speed during the drying cycle, the laundry can be evenly distributed within the drum 3 to increase a contact area between the hot heated air and the laundry. Hence, drying performance of the washing machine is enhanced and a corresponding drying time is shortened.

Accordingly, by rotating the drum at the low dewatering speed periodically during the drying cycle, the laundry can be evenly distributed within the drum to enhance the drying performance and to reduce the drying time.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A method of performing a drying cycle in a washing machine having a drum accommodating a laundry and a sensor for detecting a temperature of an air flowing in the drum, comprising:

rotating the drum at a first rotational speed; and rotating the drum using at least two different rotational speeds during a cycle for drying the laundry within the drum when the detected temperature by the sensor reaches a prescribed level, wherein the drum is periodically rotated at each of the two different rotational speeds and periodically stopped for a predetermined period of time throughout the drying cycle, to evenly distribute the laundry from a start point of the drying cycle and continuing to an end point thereof.

2. The method of claim 1, wherein the at least two different rotational speeds include the first rotational speed for a normal drying cycle and a second rotational speed for a low-speed dewatering cycle.

3. In a washing machine comprising a tub, a blower fan providing air to the tub, a heater heating the air, a drum rotatably installed within the tub to accommodate a laundry, a motor rotating the drum, a duct forming an air circulation path together with the tub to communicate with the drum, a first temperature sensor within the tub, and a second temperature sensor within the duct, a method of performing a drying cycle in the washing machine, comprising:

rotating the drum at a first rotational speed; and rotating the drum using at least two different rotational speeds during a cycle for drying the laundry within the drum when the detected temperatures by the sensors reaches prescribed levels, wherein the drum is periodically rotated at each of the two different rotational speeds and periodically stopped for a predetermined period of time throughout the drying cycle, to evenly distribute the laundry from a start point of the drying cycle and continuing to an end point thereof.

4. The method of claim 3, wherein the at least two different rotational speeds include a first rotational speed for a normal drying cycle to be applied during the drying cycle and a second rotational speed for a low-speed dewatering cycle.

5. The method of claim 4, wherein the second rotational speed is applied from a time point that the temperature detected by the first temperature sensor reaches a prescribed level.

6. The method of claim 4, wherein the second rotational speed is applied from a time point that the temperature detected by the second temperature sensor reaches a prescribed level.

7. The method of claim 4, wherein the second rotational speed is greater than the first rotational speed.

8. The method of claim 3, further comprising the step of performing a cool-air drying during a prescribed time by turning off the heater and by driving the blower fan and the motor only if a drying completion condition is met while the drying cycle is performed using the at least two different rotational speeds based on a first duty ratio between the at least two different rotational speeds.

9. The method of claim 8, wherein if the prescribed time expires from a start time point of the cool-air drying, the blower fan and the motor are turned off to terminate the drying cycle.

10. The method of claim 8, wherein the drying completion condition is that the temperature sensed by the first temperature sensor is equal to or greater than a first setup temperature or that the temperature sensed by the second temperature sensor is equal to or greater than a second setup temperature.

11. The method of claim 8, wherein the drying completion condition is that a difference between the temperatures detected by the first and second temperature sensors, respectively deviates to a prescribed value from a maximum value.

12. The method of claim 8, wherein the drying completion condition is that a setup time expires from a start time point of the drying cycle.

13. The method of claim 3, further comprising the step of ending the drying cycle directly by turning off the heater, the blower fan, and the motor if a drying completion condition is met while the drying cycle is performed using the at least two different rotational speeds based on a first duty ratio between the at least two different rotational speeds.

* * * * *